US005304707A

United States Patent [19]

Blankenship et al.

[11] Patent Number: 5,304,707

[45] Date of Patent: Apr. 19, 1994

[54] METHOD FOR SOLIDIFICATION AND ENCAPSULATION USING CORE-SHELL POLYMER PARTICLES

[75] Inventors: Robert M. Blankenship; Clarence Neyhart, both of Harleysville; Ronald W. Novak, Chalfont, all of Pa.

[73] Assignee: Rohm and Haas Company, Philadelphia, Pa.

[21] Appl. No.: 47,342

[22] Filed: Apr. 16, 1993

Related U.S. Application Data

[63] Continuation of Ser. No. 118,102, Nov. 6, 1987, abandoned.

[51] Int. Cl.[5] ..... G21F 9/16

[52] U.S. Cl. ..... 588/255; 588/249; 588/252; 523/201

[58] Field of Search ..... 588/255, 249, 252

[56] References Cited

U.S. PATENT DOCUMENTS

| | | | |
|---|---|---|---|
| 4,234,632 | 11/1980 | Lubowitz | 588/252 |
| 4,427,836 | 1/1984 | Kowalski et al. | 523/201 |
| 4,434,074 | 2/1984 | Fox et al. | 252/631 |
| 4,461,722 | 7/1984 | Knieper | 588/252 |
| 4,518,507 | 5/1985 | Conner | 588/252 |
| 4,663,086 | 5/1987 | Lefillatre et al. | 521/28 |

*Primary Examiner*—Melvyn I. Marquis
*Assistant Examiner*—Mark D. Sweet
*Attorney, Agent, or Firm*—Wendy A. Taylor

[57] ABSTRACT

A method for solidification or encapsulation of compositions containing a substantially continuous aqueous phase comprising uniformly incorporating into said compositions core-shell polymer particles and subsequently neutralizing said polymer particles by incorporating into said compositions an organic or inorganic base. The neutralized polymer particles swell and absorb substantially all of said aqueous phase.

10 Claims, No Drawings

METHOD FOR SOLIDIFICATION AND ENCAPSULATION USING CORE-SHELL POLYMER PARTICLES

This application is a continuation of application Ser. No. 07/118,102, filed Nov. 6, 1987 now abandoned.

BACKGROUND OF THE INVENTION

I. Field of the Invention

This invention relates to a method of solidification or encapsulation of aqueous-containing compositions. The compositions can be any containing a continuous aqueous phase such as slurries of ion exchange resins, cements, clays, pigments and other dissolved or suspended materials. These aqueous-containing compositions can be completely solidified by the present invention for effective disposal. The invention also has utility in encapsulating biologically-active and chemically-active materials for controlled release of same. The invention has further utility as a drying agent for aqueous-based coatings and adhesives.

II. Relevant Art

Processes for solidifying wastes are known in the art. U.S. Pat. No. 4,077,901 discloses a method for encapsulating liquid or finely-divided solid waste by uniformly dispersing the waste in a liquid thermosettable polymer composition and thereafter curing the waste/polymer under thermal and catalytic conditions. U.S. Pat. No. 4,119,560 discloses a method of treating radioactive waste by introducing the waste solution in a hot, inert, liquid carrier, flashing off the volatile solvents, and coalescing the solid waste particles with a polymeric binder which cures at ambient or elevated temperatures. U.S. Pat. No. 4,382,026 describes a process for encapsulating radioactive organic liquids by contact with insoluble, swellable polymer particles and subsequently a curable liquid resin which is cured to a solid state. U.S. Pat. No. 4,530,723 teaches a method of encapsulation of ion exchange resins by mixing with 1) boric acid or nitrate or sulfate salts, 2) a fouling agent and basic accelerator, and 3) cement. Further, U.S. Pat. No. 4,530,783 describes solidification of radioactive wastes using a composition comprising unsaturated polyesters. All of the above methods are greatly limited in the amount of liquid material which can be solidified or encapsulated by a given amount of solidifier or encapsulant (i.e. typically in the range of about 1:1 to about 2:1 parts by weight liquid material to solidifier or encapsulant).

U.S. Pat. Nos. 4,427,836 and 4,468,498 disclose core-sheath polymers which are swellable by bases and useful as opacifying or thickening agents in water-based coating compositions. Applicants have surprisingly discovered that polymer particles similar to those described in the U.S. Pat. No. '836 and U.S. Pat. No. '498 patents can be used to solidify aqueous-containing compositions, such as waste products, and to encapsulate biologically-active or chemically-active materials for controlled release.

SUMMARY OF THE INVENTION

The present invention relates to a method of solidifying or encapsulating compositions containing a substantially continuous aqueous phase comprising the steps of 1) uniformly incorporating into said compositions polymer particles having a core component and a shell component, wherein a) said core component is prepared by emulsion polymerizing one or more monoethylenically unsaturated core monomers having a —CH=C< group, and at least 5% or more by weight of said core monomers have a carboxylic acid group, b) said shell component is prepared by emulsion polymerizing in presence of said core component one or more monoethylenically unsaturated shell monomers having a —CH=C< group, and less than about 10% by weight of said shell monomers having a carboxylic acid group, c) said shell component has a glass transition temperature from about −40° C. to about 100° C. and the amount of said shell monomers having carboxylic acid group is less than about ⅓ the amount thereof in said core monomers, d) the weight ratio of said core component to said shell component is about 1:3 to about 1:20, and e) said shell component is permeable to organic or inorganic base; and 2) neutralizing said polymer particles by incorporating into said compositions containing said polymer particles an organic or inorganic base so as to swell said polymer particles and to absorb into said polymer particles substantially all of said aqueous phase.

This invention is useful in solidifying liquid waste products and encasing solid materials for disposal, in dehydrating cements, and in encapsulating chemically- and biologically-active materials.

DETAILED DESCRIPTION

Applicants have invented a novel method for solidification or encapsulation of compositions containing a substantially continuous aqueous phase. The method according to the present invention comprises the steps of 1) uniformly incorporating into said compositions polymer particles having a core component and a shell component, wherein a) said core component is prepared by emulsion polymerizing one or more monoethylenically unsaturated core monomers having a —CH=C< group, and at least 5% or more by weight of said core monomers have a carboxylic acid group, b) said shell component is prepared by emulsion polymerizing in presence of said core component one or more monoethylenically unsaturated shell monomers having a —CH=C< group, and less than about 10% by weight of said shell monomers have a carboxylic acid group, c) said shell component has a glass transition temperature from about −40° C. to about 100° C. and the amount of said shell monomers having carboxylic acid group is less than about ⅓ the amount thereof in said core monomers, d) the weight ratio of said core component to said shell component is about 1:3 to about 1:20, and e) said shell component is permeable to organic or inorganic base; and 2) neutralizing said polymer particles by incorporating into said compositions containing said polymer particles an organic or inorganic base so as to swell said polymer particles and to absorb into said polymer particles substantially all of said aqueous phase.

The core-shell polymers useful in the present invention are prepared by a multistage, sequential, emulsion polymerization process such as described in U.S. Pat. No. 4,427,836, the disclosure of which is herein incorporated by reference.

While the core may be made in a single stage or step of the sequential polymerization and the shell may be the product of a single sequential stage or step following the core stage, nevertheless, the making of the core component may involve a plurality of steps in sequence followed by the making of the shell which may involve a series of sequential steps as well.

Thus, the first stage of emulsion polymerization in the process of the present invention may be the preparation of a seed polymer containing small dispersed polymer particles insoluble in the aqueous emulsion polymerization medium. This seed polymer may or may not contain any acid component but provides particles of extremely small size which form the nuclei on which the core polymer of acid monomer, with or without nonionic comonomer(s), is formed.

As is common to aqueous emulsion polymers, there is used a water-soluble free radical initiator, such as hydrogen peroxide, tert-butyl peroxide, or an alkali metal (sodium, potassium or lithium) or ammonium persulfate or a mixture of such an initiator with a reducing agent, such as a sulfite, (more specifically an alkali metal metabisulfite, hydrosulfite, or hyposulfite, or sodium formaldehyde sulfoxylate) to form a redox system. The amount of initiator may be from 0.01 to about 2% by weight of the monomer charged and in a redox system, a corresponding range (0.01 to about 2%) of reducing agent may be used. The temperature may be in the range of about 10° C. to 100° C. In the case of the persulfate systems, the temperature is preferably in the range of 60° C. to 90° C. In the redox system, the temperature is preferably in the range of 30° C. to 70° C., preferably 30° C. to 60° C., more preferably in the range of 30° C. to 45° C. The proportion of emulsifier may be zero, in the situation wherein a persulfate initiator is used, to about 0.3 weight percent based on the weight of monomer charged to the first stage of polymerization.

Any nonionic or anionic emulsifier may be used, either alone or together. Examples of the nonionic type of emulsifier include tert-octylphenoxyethylpoly(39)ethoxyethanol, and nonylphenoxyethylpoly(40)ethoxyethanol. Examples of anionic emulsifiers include sodium lauryl sulfate, sodium dodecyl benzene sulfonate, and tertoctylphenoxyethoxypoly(39)ethoxyethyl sulfate.

The molecular weight of the polymer formed in a given stage may range from 100,000, or lower if a chain transfer agent is used, to several million. The acid-containing core polymer, whether obtained by a single stage process or a process involving several stages, has an average size of about 0.05 to about 1.0., preferably 0.1 to 0.5, more preferably 0.2 to 0.5 micron diameter in unswollen condition. If the core is obtained from a seed polymer, the seed polymer may have an average size in the range of 0.03 to 0.2 micron diameter.

The core component is the product of aqueous emulsion polymerization of one or more monoethylenically unsaturated monomers containing a group of the formula —HC=C<, wherein at least about 5% or more by weight of said monomers contain a carboxylic acid group. Examples of suitable monoethylenically unsaturated monomer include styrene, vinyl toluene, ethylene, vinyl acetate, vinyl chloride, vinylidene chloride, acrylonitrile, acrylamide, methacrylamide, and various ($C_1$–$C_{20}$) alkyl or ($C_3$–$C_{20}$) alkenyl esters of acrylic or methacrylic acid, such as methyl methacrylate, methyl acrylate, ethyl acrylate, ethyl methacrylate, butyl acrylate, butyl methacrylate, 2-ethylhexyl acrylate, 2-ethylhexyl methacrylate, benzyl acrylate, benzyl methacrylate, lauryl acrylate, lauryl methacrylate, palmityl acrylate, palmityl methacrylate, stearyl acrylate, stearyl methacrylate and the like. Examples of suitable monomers containing a carboxylic acid group include acrylic acid, methacrylic acid, itaconic acid, aconitic acid, maleic acid, maleic anhydride, fumaric acid, acrotonic acid, acryloxypropionic acid, methacryloxy-propionic acid, acryloxy acetic acid, methacrylic anhydride, methacryloxyacetic acid, monomethyl acid maleate, monomethyl acid itaconate, monomethyl fumarate and the like.

Although the core component can be prepared from monomers wherein at least 5% by weight of said monomers contain carboxylic acid, it is preferred that at least 10% by weight of said core monomers have a carboxylic acid group, more preferably at least about 30% by weight of said core monomers have a carboxylic acid group. The preferred core monomers having a carboxylic acid group are acrylic acid, methacrylic acid, acryloxypropionic acid methacryloxypropionic acid, acryloxyacetic acid, methacryloxacetic acid, monomethyl acid maleate, monomethyl acid itaconate, crotonic acid, aconitic acid, maleic acid, maleic anhydride, fumaric acid and monomethyl fumarate. The most preferred acid-containing core monomer is methacrylic acid.

After the acid core is obtained, a subsequent stage or stages of emulsion polymerization is effected to form a shell polymer on the acid core polymer particles or micelles. This may be performed in the same reaction vessel in which the formation of the core was accomplished or the reaction medium containing the dispersed core particles may be transferred to another reaction container. It is generally unnecessary to add emulsifier unless a polymodal product is desired, but in certain monomer/emulsifier systems for forming the shell, the tendency to produce gum or coagulum in the reaction medium may be reduced or prevented by the addition of about of about 0.05 to about 0.5% by weight, based on shell monomer weight, of emulsifier without detriment to the deposition of the shell polymer formed on the previously-formed core particles.

The monomers used to form the shell polymer on the acid core particles may be any of the monoethylenically unsaturated comonomers mentioned hereinbefore for the making of the core. The monomers used and the relative proportions thereof in any copolymers formed should be such that the shell thereby formed is permeable to organic or inorganic bases In spite of their hydrophobicity, the extremely non-polar or low-polar monomers (namely, styrene, alpha-methyl styrene, vinyl toluene, ethylene, vinyl chloride and vinylidene chloride) are useful alone (except in the first stage of shell formation) or in admixture with more highly polar monomers, such as vinyl acetate. Monomeric mixtures for making the shell preferably contain less than about 10%, more preferably less than about 5%, by weight of monomers having a carboxylic acid group. However, the proportion of acid in the shell polymer should not exceed one-third the proportion thereof in the core polymer. The content of acid monomers serves either or both of two functions; namely, stabilization of the final sequential polymer dispersion and assuring permeability of the shell to a base swellant. The shell has a glass transition temperature from about −40° C. to about 100° C.

The amount of polymer forming the shell component is generally such as to provide an overall size of the core-shell polymer of about 0.07 to about 4.5 microns (preferably about 0.1 to about 3.5 microns and more preferably about 0.2 to about 2.0 microns) in unswollen 5 condition before any neutralization to raise the pH to about 6 or higher. In the unswollen, unneutralized state, the weight ratio of core polymer to the shell polymer ranges from about 1:3 to about 1:20, preferably from about 1:4 to about 1:10.

The core-shell polymer particles of this invention are swollen when the particles are subjected to an organic or inorganic base that permeates the shell and expands the core. The neutralization with base thus causes the swollen core-shell polymer particles to absorb water from the surrounding medium. Any organic or inorganic base can be used to neutralize and swell the core-shell polymer particles of this invention, such as, for example, ammonia, amines, sodium hydroxide, potassium hydroxide, lithium hydroxide and the like. The preferred base is ammonia. If the glass transition temperature (Tg) of the core or shell is above standard ambient temperature, it may be necessary to heat the core-shell polymers above their Tg, or to add a solvent to soften the polymer particles, to effect swelling.

The core-shell polymers of this invention are useful in solidifying or encapsulating a wide variety of compositions containing a substantially continuous aqueous phase. Preferably the weight ratio of said aqueous phase to the core-shell polymer used according to this invention is about 10:1 or less. The compositions which can be solidified or encapsulated by the core-shell polymers of this invention may contain an all-aqueous medium or a mixture of water with alcohols, ketones or other polar, miscible solvents, provided that the core-shell polymer is not dissolved by any such solvents. These core-shell polymers can be used to solidify liquid waste products such as industrial effluents containing dissolved or suspended contaminants. The core-shell polymers are particularly useful in solidifying slurries of spent ion exchange resins, pigments such as titanium dioxide, and fillers such as clay, talc, calcium carbonate and silicon oxide. The core-shell polymers are also useful in accelerating the drying of cement and coating compositions comprising acrylic emulsions, vinyl acrylic emulsions, vinyl acetate emulsions, styrenated acrylic emulsions, styrene-butaciene-acrylonitrile emulsions or styrene emulsions or mixtures thereof. Further, the core-shell polymers can be used to encapsulate aqueous-containing compositions which contain biologically- or chemically-active materials, such as, for example, pesticides, fungicides, and fire retardants. The core-shell polymer particles containing the encapsulated biologically- or chemically-active material can then be used for controlled release of the encapsulated material.

The following illustrative examples are presented to demonstrate the present invention, but are not intended to be limitative. All parts and percentages given in the examples are by weight unless otherwise indicated.

EXAMPLE I

Preparation of Core-Shell Polymer

Core-shell polymer within the scope of this invention was prepared by sequential emulsion polymerization as described in U.S. Pat. No. 4,427,836. The composition of the core polymer was 5% butyl acrylate, 65% methyl methacrylate and 30% methacrylic acid. The composition of the shell polymer was 45% ethyl acrylate, 58.5% methyl methacrylate and 1.5% methacrylic acid. The ratio of core polymer to shell polymer was 1:7. The shell polymer had a glass transition temperature of 55° C. The final emulsion of core-shell polymer had a total solids of 48.4%.

EXAMPLE II

Solidification of Emulsion of Core-Shell Polymers

A two-ounce sample of the core-shell polymer emulsion from Example I was neutralized at room temperature with 1.5 equivalents of ammonium hydroxide based on the total acid in the core-shell polymer. The total solids of the neutralized emulsion was 47.1%. The sample remained liquid and no swelling of the polymer particles was noticed. After the sample was placed in an oven at 60° C. for 10 minutes, the polymer particles swelled to form a solid. After heating at 60° C. for a total of one hour, the sample was removed from the oven and cooled to room temperature. The sample was observed to be a very hard, solid, plastic mass.

EXAMPLE III

A two-ounce sample of the core-shell polymer emulsion from Example I was mixed with 4% 2,2,4-trimethyl-1,3-pentanediol monoisobutyrate (TPM) based on weight of polymer. When 1.5 equivalents of ammonium hydroxide were added at room temperature as in Example II, the polymer particles swelled and the sample became too viscous to pour in approximately 2.5 minutes. After 36 hours at room temperature, the sample was a hard, friable solid.

EXAMPLE IV

Core-shell polymer was prepared as in Example I, except that the shell had a composition of 52% butyl acrylate, 46.5% methyl methacrylate and 1.5% methacrylic acid. After neutralization at room temperature with 1.5 equivalents of ammonium hydroxide, the polymer particles swelled and the sample became non-pourable in about 10 seconds.

EXAMPLE V

Solidification/Encasement of Ion Exchange Beads

Spent ion exchange beads were deactivated by adding sodium hydroxide until they were completely quenched. The beads were then rinsed with water and filtered using a Buchner funnel. The final ion exchange beads contained approximately 50% water. Next, 50 grams of the ion exchange beads were added to 50 grams of the core-shell polymer emulsion from Example I and mixed thoroughly. This mixture was neutralized with 1.5 equivalents of ammonium hydroxide and no swelling of the polymer particles occurred. The mixture was then placed in an oven at 60° C. for one hour and cooled to room temperature. The mixture had become a very hard, solid mass with the ion exchange beads encased therein.

EXAMPLE VI

To the core-shell polymer emulsion from Example I was added 4% (based on weight of polymer) of TPM to lower the Tg of the polymer. 50 grams of the polymer emulsion were mixed with 50 grams of the ion exchange bead treated as in Example V. This mixture was then neutralized with 1.5 equivalents of ammonium hydroxide at room temperature. The mixture was too viscous to pour after about 2 minutes and was a very hard solid mass after one week.

EXAMPLE VII

Following the procedures from Example VI, ion exchange beads were mixed with the core-shell polymer emulsion from Ex.I, except that 8% of TPM was used. The mixture was neutralized with a mixed based of 0.5 equivalents of ammonium hydroxide and 1.0 equivalents of sodium hydroxide. The mixture solidified to form a hard, solid mass after standing over night at room temperature.

EXAMPLE VIII

Encasement of Sand Granules

Fifty grams of the core-shell polymer emulsion from Example I were mixed with 100 grams of dry 20 mesh sand. The mixture was then neutralized with 1.5 equivalents of ammonium hydroxide and placed in an oven at 60° C. The mixture was stirred frequently to suspend the sand granules. As the temperature of the mixture approached 50° C., the viscosity increased sharply. The mixture was kept in the oven for one hour and cooled to room temperature. The mixture was a hard solid mass with the sand granules encased therein.

EXAMPLE IX

Solidification/Encasement of Talc Slurry

Fifty grams of the core-shell polymer emulsion from Example I were mixed with 100 grams of a 50% talc in water slurry. The mixture was neutralized with 1.5 equivalents of ammonium hydroxide and placed in an oven at 60° C. for one hour. The mixture was then cooled to room temperature. The mixture was a hard solid mass with the talc particles encased therein.

EXAMPLE X

Use of Core Shell Polymer As Drying Enhancer for Room Mastic

Core-shell polymer within the scope of this invention was prepared by sequential emulsion polymerization as described in Ex. I. The core polymer had a composition of 5% butyl acrylate, 65% methyl methacrylate and 30% methacrylic acid. The shell consisted of two stages, with the first stage having a composition of 40% ethyl acrylate, 58.5 methyl methacrylate and 1.5% methacrylic acid and the second stage having a composition of 90% butyl acrylate, 8% methyl methacrylate and 2% methacrylic acid. The weight ratio of core to first stage shell to second stage shell was 1:2:3. The core-shell polymer emulsion was blended with an acrylic roof mastic formulation (given in Table I below) at a weight ratio of 1:4. A control blend was prepared using a bimodal acrylic emulsion (LC-67 from Rohm and Haas Co.) falling outside the scope of this invention in place of the core-shell polymer emulsion Both blends were neutralized with ammonium hydroxide and 30-mil films were cast on glass plates. The control film was dry on the surface in approximately one hour, but the inside of the film remained soft. The film containing the core-shell polymer was dry throughout the film in approximately 15 minutes.

TABLE I (Acrylic Roof Mastic Formulation)

| Ingredients | Amount (parts by weight) |
|---|---|
| GRIND: | |
| Water | 139.5 |
| Defoamer | 3.9 |
| Ethylene glycol | 25.3 |
| Dispersant | 1.5 |
| Acrylic Binder* | 114.9 |
| $TiO_2$ | 87.9 |
| $CaCO_3$ | 527.3 |

TABLE I-continued (Acrylic Roof Mastic Formulation)

| Ingredients | Amount (parts by weight) |
|---|---|
| ZnO | 58.6 |
| Thickener | 3.5 |
| LET DOWN: | |
| Acrylic Binder* | 312.4 |
| Defoamer | 6.0 |
| Coalescent | 7.7 |
| Mildewcide | 2.3 |
| Ammonium hydroxide | 7.0 |

*Rhoplex EC-1895 available from Rohm and Haas Co.

EXAMPLE XI

Use of Core Shell Polymer in Cement

In this example 50 grams of core-shell polymer emulsion from Example I were added to 100 grams of a sand/portland cement mix (3/1). In order to stabilize the polymer emulsion to the divalent ions of the cement, 1% soap (Triton X-405 from Rohm and Haas Co.) was added to the emulsion. 1.5 equivalents of ammonium hydroxide was added to the mixture and no swelling was observed The sample was placed in a 60° C. oven and heated During the heating period the sample was stirred frequently to suspend the solid particles. As the temperature of the mixture approached the Tg of the polymer (50° C.), the viscosity increased dramatically and stirring was not necessary to keep the mixture relatively homogeneous. The sample was kept in the oven for one hour and completely solidified. A control using an acrylic emulsion outside the scope of this invention was run at the same time. This control sample did not solidify during the one-hour time period in the oven.

EXAMPLE XII

Encapsulation of Pesticide

Core-shell polymer was prepared as described in Ex X. The core had a composition of 5% butyl acrylate, 65% methyl methacrylate and 30% methacrylic acid. The first-stage shell had a composition of 40% ethyl acrylate, 58.3% methyl methacrylate, 1.5% methacrylic acid and 0.2% allyl methacrylate. The second-stage shell had a composition of 66% ethyl acrylate, 32.5% methyl methacrylate and 1.5% methacrylic acid. The weight ratio of core to first-stage shell to second-stage shell was 1:4:6. The core-shell polymer emulsion had a total solids of 50%.

12 grams of the core-shell polymer emulsion was neutralized with 1.5 equivalents of ammonium hydroxide and mixed with 180 mg of pesticide (Skane M-8 available from Rohm and Haas Co.). The mixture was poured into a 1 oz. vial and heated at 60° C. in an oven for 15 minutes. After cooling to room temperature, the mixture was a solid mass containing Skane M-8 encapsulated therein. The final solid mass was tested for release of the encapsulated pesticide into an aqueous medium and compared to a control sample of pesticide which was not encapsulated according to this invention. The encapsulated pesticide had a relative release rate which was constant and approximately 4.1% of the release rate for the unencapsulated control sample.

We claim:

1. A method of solidification of industrial effluent waste compositions for disposal containing a substantially continuous aqueous phase and dissolved or suspended materials comprising:

1) uniformly incorporating into said waste compositions polymer particles having a core component and a shell component, wherein a) said core component is prepared by emulsion polymerizing one or more monoethylenically unsaturated core monomers having a —CH=C< group, and at least about 5% or more by weight of said core monomer have a carboxylic acid group, b) said shell component is prepared by emulsion polymerizing in the presence of said core component one or more monoethylenically unsaturated shell monomers having a —CH=C<group, and less than about 10% by weight of said shell monomers have a carboxylic acid group, c) said shell component has a glass transition temperature from about −40° C. to about 100° C. and the amount of said shell monomers having a carboxylic acid group is less than about ⅓ the amount thereof in said core monomers, d) the weight ratio of said core component to said shell component is about 1:3 to about 1:20; e) said shell component is permeable to organic or inorganic bases, and f) said polymer particles are insoluble in said waste compositions; and 2) neutralizing said polymer particles by incorporating into said waste compositions containing said polymer particles an organic or inorganic base so as to swell said polymer particles and to absorb into said polymer particle substantially all of said aqueous phase.

2. A method of claim 1 wherein at least about 10% or more by weight of said core monomers have a carboxylic acid group.

3. A method of claim 1 wherein at least about 30% or more by weight of said core monomers have a carboxylic acid group.

4. A method of claim 1 wherein said core monomers having a carboxylic acid group are selected from the group consisting of acrylic acid, methacrylic acid, acryloxypropionic acid, methacryloxy-propionic acid, acryloxyacetic acid, methacryloxyacetic acid, monomethyl acid maleate, monomethyl acid itaconate, crotonic acid, aconitic acid, maleic acid, maleic anhydride, fumaric acid, monomethyl fumarate, and methacrylic anhydride.

5. A method of claim 4 wherein said core monomer having a carboxylic acid group is methacrylic acid.

6. A method of claim 1 wherein less than about 5% by weight of said shell monomers have a carboxylic acid group.

7. A method of claim 1 wherein the weight ratio of said core component to said shell component is about 1:4 to about 1:10.

8. A method of claim 1 wherein the said base is selected from the group consisting of ammonia, amines, sodium hydroxide, potassium hydroxide, and lithium hydroxide.

9. A method of claim 1 wherein the weight ratio of said aqueous phase to said polymer particles is about 10:1 or less.

10. A method of claim 1 wherein said waste composition contains spent ion exchange resins.

* * * * *